US008777718B2

(12) United States Patent
Smith et al.

(10) Patent No.: US 8,777,718 B2
(45) Date of Patent: Jul. 15, 2014

(54) SHORT-LINE BINGO METHOD AND APPARATUS

(76) Inventors: Ray Smith, Linden, NJ (US); Amanda Tears Smith, Linden, NJ (US)

( * ) Notice: Subject to any disclaimer, the term of this patent is extended or adjusted under 35 U.S.C. 154(b) by 320 days.

(21) Appl. No.: 13/441,576

(22) Filed: Apr. 6, 2012

(65) Prior Publication Data

US 2013/0267298 A1 Oct. 10, 2013

(51) Int. Cl.
*A63F 3/06* (2006.01)

(52) U.S. Cl.
USPC ..... 463/19; 463/18; 273/269

(58) Field of Classification Search
USPC ..... 463/18, 19; 273/269
See application file for complete search history.

(56) References Cited

U.S. PATENT DOCUMENTS

| | | | | |
|---|---|---|---|---|
| 5,624,119 | A * | 4/1997 | Leake | 273/269 |
| 5,935,002 | A | 8/1999 | Falciglia | |
| 6,565,091 | B2 | 5/2003 | Weingardt | |
| 7,481,707 | B1 | 1/2009 | Luciano | |
| 7,695,361 | B2 | 4/2010 | Lind | |
| 7,794,319 | B2 | 9/2010 | Luciano | |
| 8,002,623 | B2 | 8/2011 | Resnick | |
| 8,070,161 | B2 | 12/2011 | Ward | |
| 2004/0121834 | A1 | 6/2004 | Libby | |
| 2006/0160603 | A1 | 7/2006 | Lulek | |
| 2006/0287058 | A1 * | 12/2006 | Resnick et al. | 463/19 |
| 2011/0045890 | A1 * | 2/2011 | Khal | 463/19 |

* cited by examiner

*Primary Examiner* — Damon Pierce
(74) *Attorney, Agent, or Firm* — Mark A. Litman & Associates, P.A.

(57) ABSTRACT

A method of playing a wagering game on an electronic gaming system provides:

i) an image of a virtual playing card having frames within m columns and n rows wherein each of m and n are at least 3;

ii) providing a random distribution of individual numbers within the frames, the individual numbers selected from within a complete defined set of numbers;

iii) recognizing a wager;

iv) selecting a second set of numbers smaller than the complete defined set;

v) identifying on the monitor selected numbers matching individual random numbers within the frames;

vi) identifying when consecutive frames have at least p matched individual random numbers within frames in a column, row or diagonal;

vii) resolving the at least wager such that a) when matched individual random numbers do or do not form at least p adjacent frames.

15 Claims, 3 Drawing Sheets

Example Bingo Terminal Screen With Complex Entertainment

SHORT-LINE BINGO METHOD AND APPARATUS

BACKGROUND OF THE INVENTION

1. Field of the Invention

The present invention relates to the field of wagering games, particularly wagering games in which random selections are distributed onto a defined field according to the number or symbol of the selection, particularly as in bingo or keno.

2. Background of the Art

In the gaming industry, the underlying basis of all games is the provision of random events having determinable measures of outcomes. Wagers are placed against specific outcomes, and those wagers are resolved based upon the final or intermediate outcome of events. Many different gaming elements are used to provide the random outcome of events, including but not limited to playing cards, dice, roulette wheels, candy wheels, random ball selection, and since the introduction of processors to the gaming industry, random event generation through random number generator. The use of random number generators and processors has enabled the generation of random symbols and numbers corresponding to the physical objects traditionally used in wagering games such as the dice, playing cards, roulette wheels and random ball selection (as in bingo and keno). The addition of processors enables more rapid play, and more ability to design variations in game play than with purely physical systems. Many different and new forms of wagers can also be provided and more quickly resolved by the processor than by croupier or dealer manual resolution.

Basically, players buy cards with numbers on them in a 5×5 grid corresponding to the five letters in the word B-I-N-G-O. Numbers such as B-2 or 0-68 are then drawn at random (out of a possible 75 in American Bingo, and 90 in British and Australian Bingo) until one player completes a 'Bingo' pattern, such as a line with five numbers in a vertical, horizontal or diagonal row on one of their cards and wins the prize. There are many possible patterns to play for. There are some variants of Bingo that use 3×3 playing cards.

A bingo Card contains 24 numbered spaces and one free space (blank), with which you play BINGO. The numbers are assigned at random on each card and are arranged in five columns of five numbers each by five rows (5×5=25 in total including the blank square).

The numbers in the B column are between 1 and 15, in the I column between 16 and 30, in the N column (containing four numbers and the free space) between 31 and 45, in the G column between 46 and 60, and in the O column between 61 and 75.

Players have thousands of unique (unduplicated) cards to choose from. Some manufacturers print unduplicated series of 6,000 cards. There are also series of 9,000 cards available. Hard cards and Flimsy cards have a series number printed on them. For example, card number 1252 will always have the same numbers in the same spaces.

Among the variants of Bingo that have been suggested in the art are the following. U.S. Patent Application Publication No. 20060160603 (Lulek) discloses a video gaming system that combines multi-card bingo play with familiar and desirable entertainment elements such as spinning reels with fruit or other symbols. The game programming produces multiple bingo card representations on monitors at a plurality of game terminals. Drawn numbers ("balls") are displayed one after another. An eight card bingo game pays a prize for a bingo win achieved on a card when less than a predetermined number of balls have been drawn and also when a cover-all or other predetermined game-ending pattern is achieved on a card that has not previously provided a prize affording win. A nine card eight line game displays bingo cards in a three-by-three grid. Prizes are awarded for pre-selected bingo wins accomplished in one of eight three-in-a-row patterns of cards running horizontally, vertically or diagonally. In the nine card, eight line game each winning card is associated with a symbol representative of the bingo win. The symbol is presented by a representation of a spinning reel coming to rest at that symbol.

U.S. Patent Application Publication No. 20040121834 (Libby) discloses a lottery bingo system graphically portraying an animated bingo game. The lottery system includes a bingo game generator which comprises an animation drawing subsystem. The animation drawing subsystem retrieves bingo call video segments corresponding to a sequence of drawn bingo numbers randomly drawn for a bingo game after dispensing of bingo tickets for the bingo game is ended, and compiles the bingo call video segments into a bingo game video.

U.S. Pat. No. 8,070,161 (Ward) describes wagering systems using a game ball has two different game indicia associated therewith. One or more of such game balls may be part of a set of game balls, such as a set of balls used to play a bingo, keno or lottery game where the game indicia may comprise numbers used to play lottery or keno, or combinations of letters and numbers for play of a bingo game. Compared to game balls bearing a single game indicia, selection of a game ball bearing multiple game indicia presents a player with an increased or bonus matching opportunity. The game balls may be physical elements or be electronic representations, such as displayed images, thereof.

U.S. Pat. No. 8,002,623 (Resnick) provides methods and devices for presenting a plurality of game elements on one or more display devices. The game elements may comprise, for example, bingo cards, playing cards, hands of playing cards, etc. Some implementations of the invention involve displaying a plurality of game elements as surfaces of a three-dimensional object. Preferably, the orientation of the three-dimensional object can be varied to display selected game elements. The game elements may be selected by a player and/or by a logic device. In some implementations, the three-dimensional object comprises a "carousel" that can be re-oriented (e.g., rotated) to display game elements.

U.S. Pat. Nos. 7,794,319 and 7,481,707 (Luciano) disclose a system and method for generating bingo game bonuses that are non-banked, for use with pooled bingo games. The system generates pools of money for use in bingo games by deducting a percentage of the amount used to purchase bingo cards (in the present invention, virtual bingo cards). Each bingo game automatically enrolls active players in one or more bonus games, exemplified by "4 corners," where the amounts to be given away to players as bonuses are calculated to be equal, over time, to the amount taken in from players buying bingo cards. The house has no stake in the bonus awards.

U.S. Pat. No. 6,565,091 (Weingardt) describes a bingo game in which bingo numbers are assigned to at least five different groups. The groups are preferably identified by color, and the size of the groups preferably vary, with the result that a bingo consisting of a combination of numbers from the smallest group will be harder to achieve than a bingo consisting of a combination of numbers from a larger group. The jackpot sizes will vary in relation to the difficulty of achieving a particular bingo. The group sizes are within certain preferred ranges, designed to minimize the risk of premature bingos and thus to increase jackpot size and player excitement. Preferably, image type indicia are also added to certain of the numbers, creating additional bingo combinations and jackpot opportunities.

U.S. Pat. No. 7,695,361 (Lind) describes determination of a pattern probability by for each of a number of target patterns achievable in a bingo-type game. Each pattern probability comprises a probability of achieving the respective target pattern in the bingo-type game. Different pattern sets are then associated with each different prize level in a desired prize distribution. The target patterns and their respective pattern probabilities are assigned or mapped to the different pattern sets so that the probability of achieving any target pattern included in a pattern set comprises a value approximating the desired probability of the prize level with which the pattern set is associated.

U.S. Pat. No. 5,935,002 (Faciglia) describes a device for playing a bingo-style game including an input device for receiving user inputs; a display for displaying a graphic user interface (GUI); and a processor. The GUI includes a five column by five row random number display matrix; five display regions; and a plurality of user-actuatable icons. The processor includes a first random number generator for generating five sets of random numbers for display by the five column by five row random number display matrix, in which the five sets of random numbers are grouped in predetermined ranges. The processor also includes a second random number generator which responds to the user inputs corresponding to actuation of the actuation icon by the user for generating a sixth set of random numbers for display by the five display regions. The processor compares the sixth set of random numbers displayed in the five display regions with the numbers in the columns of the display matrix, and allows the processor to automatically cover the matching number in the display matrix. The processor determines whether the display matrix has five numbers covered in a row, in a column, or in a diagonal, and generates a bingo indication signal for indicating a bingo condition.

SUMMARY OF THE INVENTION

A variant of bingo and/or keno is played in a form that would be recognizable to bingo and/or keno players yet add significant variation to the game to provide increased entertainment at a fast pace. A card (either virtual or physical) is provided having columns and rows of open frames in which a random distribution of numbers drawn from a complete set of numbers is provided within the rows and columns, usually a single number in each frame. Subsets of the complete set of numbers are designated to appear only in certain sections of the game card. After a wager has been received on a game, a source of a complete set of numbers is provided for distribution among the frames. A random selection is made (e.g., provided by a random number generating event such as ball selection, a spinning wheel, or random number generator) of a second set of fewer numbers than the full set of numbers. A fixed amount (a fixed number) of numbers is drawn from each subset to it's designated game card section. The selected numbers matching the random distribution of numbers in the open frames are highlighted on the cards or reserved in memory of a processor. Rather than waiting for an end of game event of an individual player or a tie among multiple players filling a line, column or row, when the final number provided in the second set (being less than the total number of available numbers) has been selected, all matching numbers are inspected. Specific sets of numbers (e.g., three consecutive frames or more) are pre-identified as winning events. The wagers are then resolved against a paytable based upon matching outcomes identified in the paytable. Instead of numbers, non-numerical symbols or alphanumerics may be used in a similar manner. The game may be played with (2, 3, 4, 5 etc.) multiple cards in which the random distribution of numbers will include all numbers in the complete set, scattered over multiple cards. Smaller and independent games may be played by treating rows and columns as independent game fields. The second set of drawn numbers, may designate multiple colors or other designations for each selected number, for all selected numbers or for sets of numbers (e.g., odd-even; divisible by 2, 3, 4 or 5; continuous sets such as 1-10, 11-20, 21-30, etc. and the like so that each number is within only one set, and although preferable that less than all selected numbers have a designated color or other designation, some games may allow for all numbers (every selected number) to have a further color or other designation) to further distinguish the number and the game outcome and offer bonuses.

DETAILED DESCRIPTION OF THE INVENTION

Figure 1:
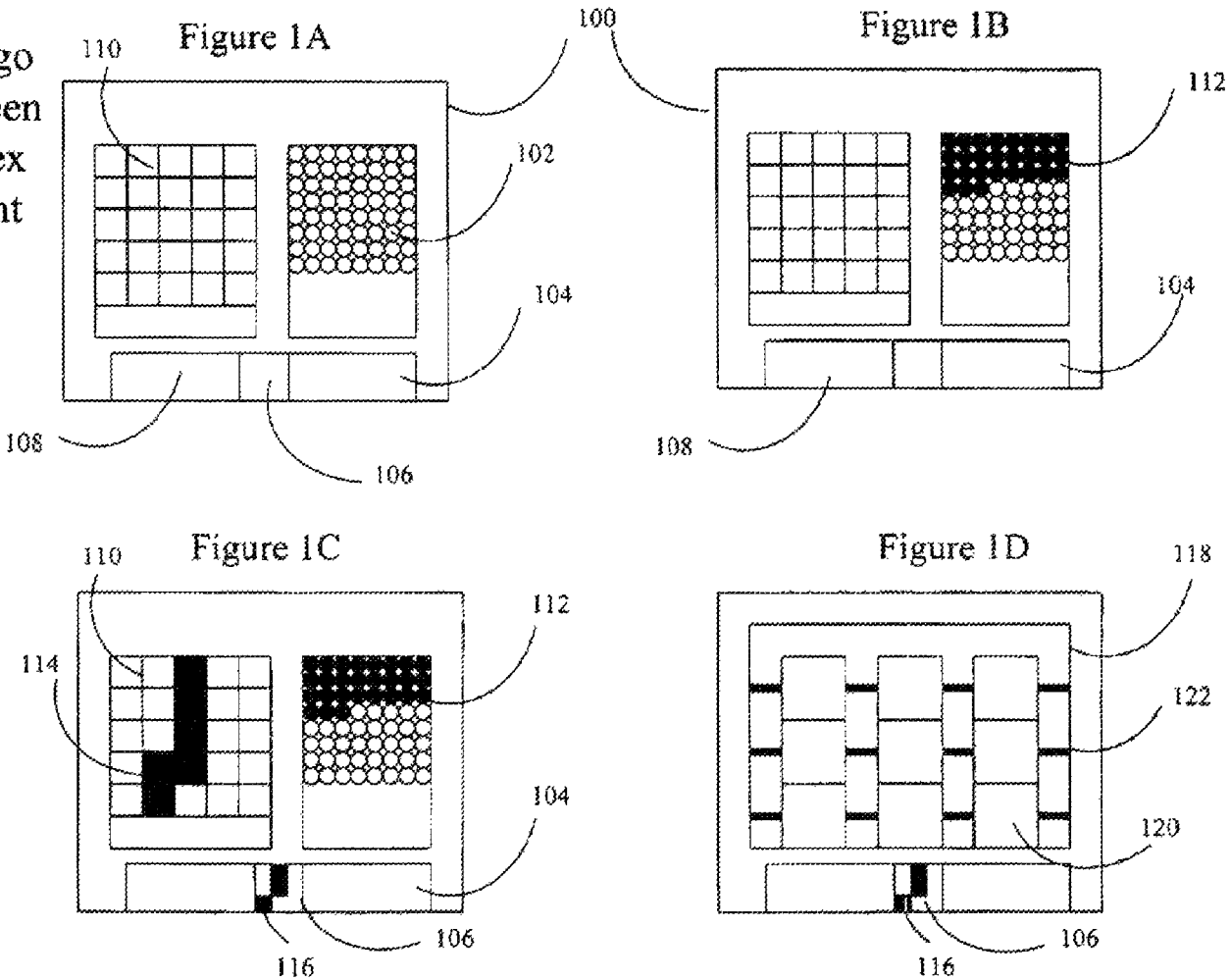
FIG. 1 is a schematic of a system enabling practice of the invention.
Figure 2:
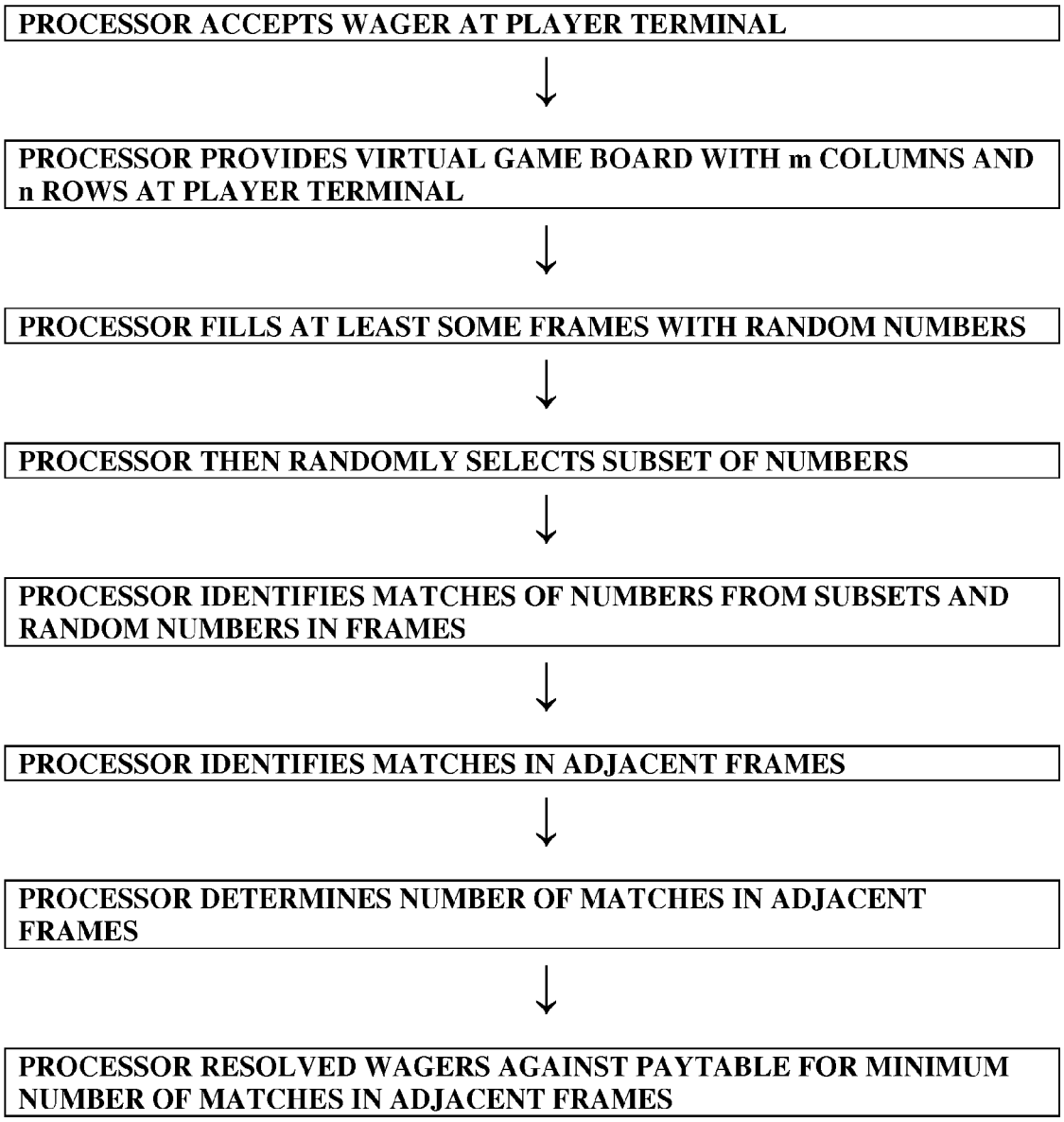
FIG. 2 is a flow diagram for a process according to the present invention.

A "bingo" game card (either virtual or physical) is provided having columns and rows of open frames in which a random distribution of numbers is provided within the rows and columns, usually a single number in each frame. The cards will have a minimum of 3×3 columns and rows. The cards may be provided with equal numbers of rows and columns or uneven numbers of rows and columns, such as 3×4, 4×4, 4×5, 5×5 and the like. Each frame will typically have a random number within it. The randomness of the number may be moderated by allowing only a range of numbers within either columns (as is typically done in bingo (where in Column B, only 1-15 may be allowed; in column I only 16-30 may be allowed; in column N only 31-45 may be allowed; in column G only 46-60 may be allowed; and in column O only 61-75 may be allowed) or as is typically done in keno with only 1-10 allowed in the top row, 11-20 in the next row, and so on). These limited number ranges are referred to herein as "column sets" or "row sets" for convenience. The column sets may be ranges or other categories assigned to each column or row. The card may also be provided with one "Free" square positioned on the card. In standard Bingo physical cards, the Free square is usually only in the centermost square. In a computer generated game card, the Free square may be omitted or randomly distributed on a card. Where the numbers allowed in each column (or each row) are limited (with secondary distinctions, e.g., by range or other factor, such as odd and even, within continuous sets, and the like as described above), the additional impact of secondary distinctions can be used for bonuses or for separate games. For example, in a row of ten numbers, if 5 numbers appear in the selected numbers, the presence of a particular color or a minimum amount of numbers (e.g., 3 number) with that particular color can increase the award. Additionally, a separate game or consolation game may be used where if there are only three numbers in a row where ten (10) numbers could be placed (which might not be a payout event), if the three numbers are the same color or particular combinations of colors, there might be a minimum payout, such as 1 credit, or a push on the underlying wager.

After a wager has been received on a game, a source of a complete set of numbers is provided for distribution among the frames. For example, as noted above in a typical 5×5 standard Bingo games up to 75 numbers may be in the available set. The range of available numbers may be adjusted to alter the odds. For example, starting with a base line of 75 numbers for comparison, the probability of a number being drawn for each frame increases as the total number in the original set decreases. Similarly, the probability of a number being drawn for each frame decreases as the total number in the original set increases. The random sets of numbers selected (the "total selected set") that are less than the complete set may be selected as subsets of the column sets or row sets. For example, if there are 15 numbers allowed in column B, then the game may be played with only a number (the "selected column set numbers" or "selected row set numbers") of fewer than 15 numbers being selected for each column. The same number may be selected for each column (or row) or different columns or rows may have different numbers in the column sets or row sets may be selected. The game may also be played with wagers being different for playing numbers of "lines," such as wagering on only column B, or the top most row, or columns I and G only, etc.

The random sets of numbers (the selected sets, the selected column sets or the selected row sets) may also be subsets of the total available numbers. A random selection is made of a second set of fewer numbers than the full set of numbers. By selecting fewer numbers, the probabilities of total column or total row filling is adjustable, and likewise the probability of winning events is adjustable. The selected numbers matching the random distribution of numbers in the open frames are highlighted on the cards. Rather than waiting for an end of game event of an individual player or a tie among multiple players filling a line, column or row, when the final number provided in the second set has been selected all matching numbers are inspected. Specific sets of numbers (e.g., three consecutive frames or more) are pre-identified as winning events. The wagers are then resolved against a paytable based upon matching outcomes identified in the paytable.

The paytable may award random outcomes for various specific outcomes, such as those selected from the group consisting of three consecutive frames in a column, row or diagonal; four consecutive frames in a column, row or diagonal; five consecutive frames in a column, row or diagonal; doubles of five frames in a column, row or diagonal; and the like. As noted above, the initial wager on a game may be for an entire card (as is typical in bingo), or individual wagers may be made or required for each column, all columns, each row, all rows, each diagonal and/or all diagonals. The numbers on cards need not be in order down the column, such that the card may read 3, 12, 8, 5, 14. With physical cards, the selected set of numbers may be daubed on the card. With electronic play on a video monitor, the game processor will automatically identify matches from processor selected numbers and the numbers on the electronic cards on which wagers have been placed. The numbers in frames on electronic cards my be randomly positioned by the processor or game controller, or players may design cards by selecting and inputting specific numbers into each frame. Designed cards may be saved and repeated from game to game.

In the electronic version, multiple "layers" of game cards may be used to create a three-dimensional game element that could be the object of a wager. A single wager may again be placed on individual cards (e.g., one card up to a number of cards equal to or greater than the number of columns or rows in the top card (or any other card) or multiple cards (e.g., the top card and the next adjacent card; three adjacent cards, four adjacent cards, five adjacent cards). The wagering in three-dimensions allows larger numbers of paylines in the game, may require either larger numbers of wagers (for each payline, as Is done on video reel-type slot machines) and/or reduced payouts for events that would be paid higher odds on a single card or a progressive jackpot can be paid based on a full 3D cover on all cards in play. For example, note the following paytables for the types of games played. The amounts are examples and are not intended to be limiting on the enforceability of claims.

Single 5×5 Card

| EVENT | PAYOUT ODDS |
|---|---|
| Three Adjacent Frames Filled | 1:1 to 3:1 |
| Four Adjacent Frames Filled | 4:1 to 10:1 |
| Five Adjacent Frames Filled | 11:1 to 30:1 |
| Two Sets of Four Adjacent Frames Filled | 30:1 to 80:1 |
| Two Sets of Five Adjacent Frames Filled | 70:1 to 150:1 |

Five 5×5 Cards

| EVENT | PAYOUT ODDS |
|---|---|
| Three Adjacent Frames Filled | 1:1 to 2:1 |
| Four Adjacent Frames Filled | 2:1 to 6:1 |
| Five Adjacent Frames Filled | 7:1 to 15:1 |
| Two Sets of Four Adjacent Frames Filled | 16:1 to 30:1 |
| Two Sets of Five Adjacent Frames Filled | 30:1 to 50:1 |

The number selection may be performed by random selection of physical balls or the virtual selection of virtual balls by a processor. In using physical balls, since numbers may be restricted to particular columns or rows, there may be individual selection units that provide separate selection capability for each column (or row). For example, one ball selector may contain the specific number of balls allowed in each particular column (or row) to select that number. Another alternative physical structure for selecting limited numbers for each column or row would be to segregate the sets of balls, run each set through a single selection unit, randomly select a "selected column set" of balls from a first segregated set of balls, return the residual balls to a segregated storage area, and then introduce a next set of segregated balls into the single selection unit, and repeating the process until all sets of selected column sets have been chosen. The individual column subsets are kept segregated so that the process can be repeated for a next game. All of the above procedures may similarly apply to Keno.

FIG. 1 is an architectural overview of the primary system components of a bingo game system in accordance with the present invention. Bingo Game Managers (BGMs) 100 represents a BGM connected to a player terminal. The connection may be hardwire or be an ethernet based network (can be any LAN or other systems interconnection technology, including but not limited to wireless) when installed in a building or reasonably close set of buildings. If the installation spans large areas the connection may be networked to connect the BGC (Bingo Game Controller) through any operable combination of LAN/WAN in combination with networked connections using IP addressing or other commercially available networking technologies. FIG. 1A illustrates an exemplar bingo game with entertainment display, FIG. 1 applying equally to banked and non-banked modes. Shown is a video display 100 (flatpanel, traditional cathode ray tube, or any other visual display means) that is part of a bingo player terminal (BPT) of the present invention. Bingo card 110 is displayed, having numbers in each square according to normal bingo rules. Empty ball set 102 is also shown; there will be 75 empty (non-labeled) circles representing balls, to accommodate the full number of bingo balls it is possible to draw in a single game. At the bottom of visual display 100 is a smaller version of bingo card 110, bingo card 106. Also shown are player input area (touchscreen) 108 and message area 104. Before play starts, message area 104 will contain a message such as "Waiting To Start", "Ready To Play", or something similar to let a player know the game is ready for use. Bingo cards 110 and 106 may be blank or have a "pre-play" or "display" set of numbers shown, as game designers see fit. Likewise with the drawn bingo ball set 102 before actual game play starts; there may be blank balls, a previous ball draw, or a standard ball display. Various attract mode displays may be used as well. One embodiment will have the balls blank while waiting for a player, providing further visual indicia the game is ready for play. In yet another embodiment a sequence of images showing exemplar game plays is shown, which both attracts players and illustrates to new players how to play the game.

FIG. 1B shows visual display 100 after a player has begun play, and a set of balls has been drawn. The initial ball set 112, a subset of the full ball draw, will vary with each game as described more fully below. Ball set 112 is shown as dark due to the limitations of this graphic representation, but the actual visual display will typically have numbers inside each ball showing the drawn ball numbers and their order (received from a BGM). The message in 104 will now display a message such as "Daub Now" or something similar, coupled with a visual timer (not shown). The visual timer could take many forms, including a small clock-face showing a second-hand running towards 12; a color-bar with green to the right of a divider and red to left—as time goes buy, the divider moves from right to left showing less green (less time) and more red. When the color-bar turns all red, second-hand reaches 12, etc., the player can no longer daub and has missed their chance to win based on this set of balls. To daub, the player touches touchscreen input area 108, containing a daub indicator area therein.

As will be understood by those knowledgeable in this art, touchscreen input is a single exemplar of a user input device; any user input device enabled to send a signal to the electronic, photonic, or other analogue or logic circuitry within a player terminal may be used.

FIG. 1C illustrates the effect of daubing. Any balls in ball set 112 that matched numbers on bingo cards 110 and 106 are marked, and are shown as blanked out areas 114 on card 110 and blanked out areas 116 on small card 106. The actual screen can make use of any means to visually distinguish the "daubed" squares, including but not limited to reverse video imaging, letter/number highlighting, background color changes, etc. This bingo game is now concluded. The player now has a choice of seeing an entertainment display or not, the choice being indicated in display area 104. If a player chooses (alternatively, if the player chose earlier in the game session) to see the entertainment display, the prize results in the form of a game animation are shown in FIG. 1D. Small bingo card 106 with the blanked out (daubed) areas 116 for this game stay on the screen from FIG. 3 to FIG. 4. Screen area 118 now displays an image of slot reels 120 (or simulates another game of chance) having a same win value as bingo card 106 with daubed areas 116. Shown is a multi-payline (122 shows one payline) 3 reel slot type entertainment display.

FIGS. 1A through 1D were shown with a single bingo card and single entertainment display. A single card was used to keep visual clutter to a minimum, as the graphical representation in this application would become unreadable if a plurality of cards were drawn; however, the present invention may be used with any number of cards bought and used by a player. The number of bingo cards in simultaneous play is limited primarily by ergonomic considerations and the available visual elements (screen size and visual clarity or display resolution) of the game machine. Low-end or bar-top machines will typically have small, poor resolution screens which enable the reasonable use of one or perhaps two cards; high-end machines will have larger screens with higher resolution, enabling a plurality of cards to be readably displayed simultaneously. The present invention includes the use of any number of cards on any particular game machine.

Further, any visual method used to enable both a bingo card and the entertainment display to be made visible to a player may be used; exemplars include fading the bingo card and superimposing the entertainment display on top of it, having a small version of the bingo card somewhere on the screen while the majority of the screen is used for the entertainment display, showing the bingo game card and entertainment display in alternating visual sequences, showing the bingo card then followed by the entire entertainment display sequence then followed by the same bingo card, having two separate displays with one always showing the bingo card and the other used for the entertainment display, etc.

The BGC is connected to a set of bingo player terminals (BPTs), typically more than one and up to or inclusive of 16-32 BPTs per BGC, constrained only by the processing power of the BGCs and the networking technology. For small or new installations, the functionality found in the BGMs and BGCs may be combined into one physical computer, which can either be connected to the BPTs via a network, or still be connected via serial ports to a BGM, with the serial ports being part of the hardware on which the BGM is running. The typical installation may have either separate BGCs and BGMs, or may combine a BGM and the functionality of one or more BGCs in a single physical computer. Further, in very small installations using a single BGM, the BGM, having the functionality of the BGCs, may even be housed inside of a BPT and may share hardware with the BPT.

BGCs are designed to locally control the BPTs connected to them, handling protocol conversion and other tasks. In one embodiment each BPT will be connected to a BGC using, for example, an RS-485 serial connection with a poll-select protocol, as opposed to the LAN or combination LAN/WAN connection between the BGCs and the BGMs. In another embodiment, ethernet-based LAN connections will be used between BPTs, BGCs, and BGMs which are co-located in a single facility.

BGCs are comprised of both hardware and software, whose functionality is explained more fully below. The BGC hardware for use with the present invention will be similar in design and construction to the lottery game controllers (LGCs, e.g., those that are proprietary to Sierra Design Group, Inc., of Reno, Nev.), also similar to remote game controllers (RGCs). LGCs/RGCs typically have a set of serial ports (e.g., RS-485), a LAN connection (typically ethernet), a text-only user interface using LCDs or similar display capabilities, and a small user input device, typically a keypad or touchscreen. PC-based LGC configurations may also be used, which are then typically set in a secure housing or in a secure location within the gaming establishment. The game may also be played over the internet, with a central server providing the game control system, and wireless or hardwired connections enabling communication by individual players to the central server.

All have a programmable microprocessor having volatile and non-volatile memory and an operating system, currently an embedded Unix but further including, in future embodiments, LINUX or Windows® operating system (OS). The software may be specific to the BGC to handle the needs of the bingo game system of the present invention. "Specific" does not mean wholly unique; rather, it means unique additions or extensions to existing software components, changes to some software components, and no changes to other software components (i.e., low-level drivers or the embedded O.S.). As used in this description, "software" includes firmware and any other code executable by a processor, in addition to an (embedded) OS and application software.

The BPTs will initially use the same hardware as the video player terminals typically seen and used in casinos, normally called "video slot machines" or "video lottery terminals," with new software to enable their use with the present invention. This includes but is not limited to uprights, tombstones, slant tops, and bar top style machines. They will have known internal components typical for a player terminal, including a programmable processor, volatile and non-volatile memory, interfaces to player input devices (buttons, handles, keypads, touch screens, voucher readers, magnetic card slots, etc.) and player output devices (video on screen, audio, lights, voucher writers, etc.), and may have other input/output devices such as IR or RF transceivers, coin hoppers, etc., plus at least one network connection. Due to the nature of bingo, the old-style "pull-handle" found on most upright player terminals will preferably be left off, although that is not a requirement. The software running in the player terminal will be specific for use with the present invention, where "specific" is used in the same way as described above for BGCs and will include unique software packages and modifications to run the bingo game of the present invention.

As more BPTs are put into use, it is expected that unique hardware configurations will be produced and used in addition to the general BPTs described above. This may include hand-held devices specifically designed for use with the present invention, having both wired (plug-in compatibility) and wireless network connections. Any BPT having the needed functionality for use with the system of the present invention is fully contemplated, regardless of physical configuration.

BGMs may initially be implemented as individual computer systems or servers sitting on a backbone network, the network also connected to the BGCs. In some cases the BGMs may be networked directly to the BPTs; this is expected to become the norm as newer systems not having legacy game controllers that need to be kept in use for certain games or progressives are installed. Examples of computer systems usable as a BGM include, but are not limited to, a server system from Compaq™, such as the DL370 series running Windows 2000 Server™ and SQL Server. Alternatively, the BGM may run on hardware using either the QNX or LINUX operating systems with a compatible relational database management system. In installations where the BGM takes over the functionality of the BGC, special I/O hardware (an I/O adapter board and a series of added external serial ports) will typically be required. The software needed to run with the present invention will be installed on an applicable computer used for a BGM, where the hardware and software used will depend on the performance and costing needs of a particular site.

Figure 3:
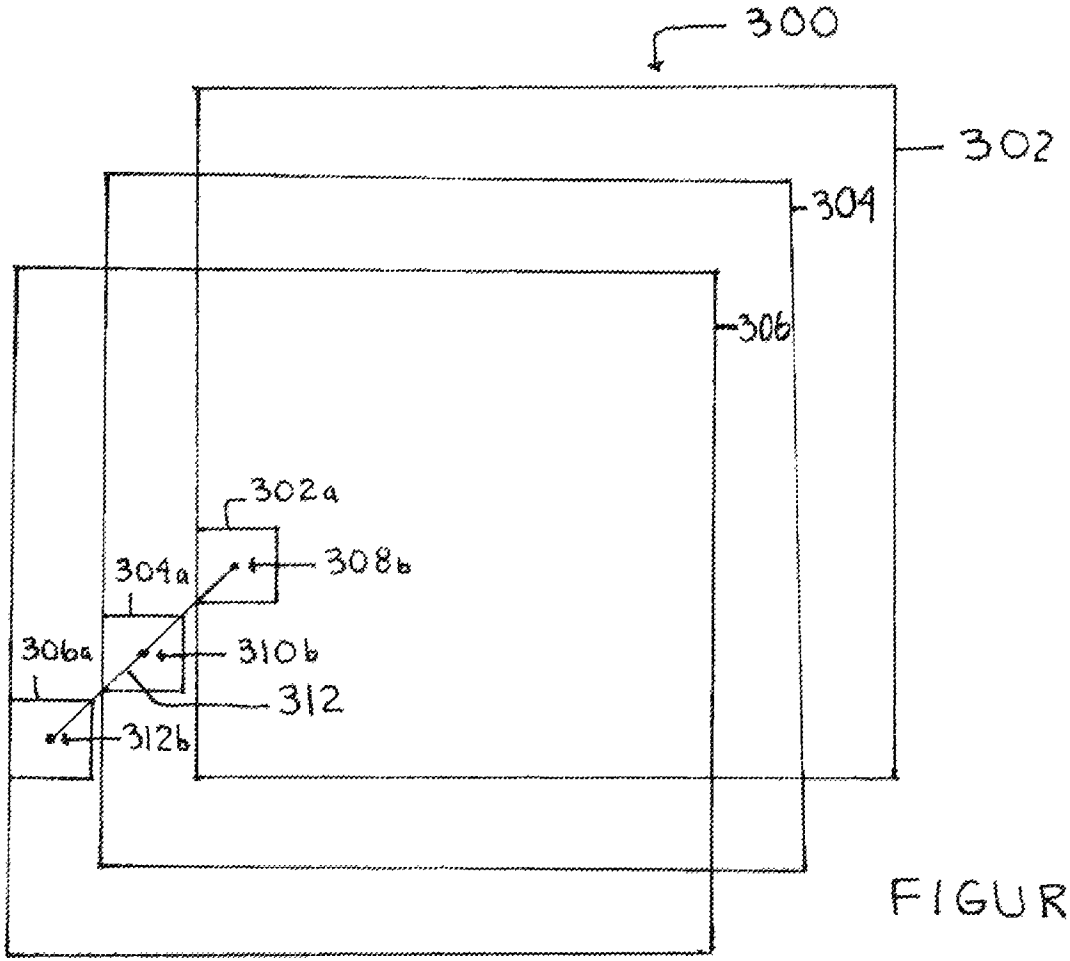
FIG. 3 shows a three-tiered (three-dimensional) set of game boards with a payout line shown in three dimensions.

FIG. 3 shows a three-tiered (three-dimensional) set of game boards 300 with a payout line shown in three dimensions 312. The top game board 302 is shown, as it preferably would be displayed on a display screen, biased over a second game board 302 which is in turn biased over a third game board 306. A single set of three aligned, in perspective three-dimensional frames 302*a* 304*a* and 306*a* are shown that form a vertical (even though shown skewed for perspective) alignment of three frames, their center-points 308*b* 310*b* and 312*b* forming the payout line 312. Diagonal lines (not shown) and other special outcomes (e.g., four corners among the three game boards, eight corners among the three game boards, twelve corner among the three game boards, matching runs of 3, 4 or 5 numbers overlying each other in the three game boards, etc.) may also be used for game payouts.

A preferred method of play on an electronic gaming system would include an electronic gaming machine system comprising: (A) an electronic game engine including (1) a processor; (2) program-containing memory; (3) a player input terminal; (4) an electronic communications receiving and sending means for connecting the player terminal to the processor; (5) a video monitor at the player input terminal;

(B) the processor configured to execute software in program-containing memory to perform a process comprising:

i) providing an image of a virtual playing card having m columns and n rows and diagonals of open frames at a monitor at player terminal, wherein each of m and n are at least 3;

ii) providing a random distribution of individual numbers within the frames, the individual numbers selected from within a complete defined set of numbers, the complete defined set of numbers having predefined subsets of numbers that appear only in particular game card sections selected from the group consisting of rows or columns;

iii) recognizing at least one wager at a player terminal;

iv) the player input terminal identifying to the processor a selected second set of play numbers from within the complete defined set of numbers, wherein the second set of play numbers is smaller than the complete defined set, v) the processor randomly selecting a predetermined number of numbers from each subset; vi) identifying on the monitor selected numbers from v) matching individual random numbers within the frames from iv);

vii) identifying when consecutive frames have at least p matched individual random numbers within frames in a column, row or diagonal on a monitor at a player terminal, wherein p is greater than 1 and up to m and n;

viii) resolving the at least wager such that a) when matched individual random numbers do not form at least p adjacent frames, collecting the wager, and b) when matched individual random numbers do form at least p adjacent frames, resolving the at least one wager by providing credit at the player terminal where the at least one wager was recognized.

The present technology may also be played on the internet and be web-based. Individual players on individual processors or thin-client devices may engage with a central processor or master connection and the player (usually through credit or available value for wagering) may play the game from a distant location as are other games, including bingo, presently played on the web.

The invention claimed is:

1. An electronic gaming machine system comprising: (A) an electronic game engine including (1) a processor; (2) program-containing memory; (3) a player input terminal; (4) an electronic communications receiving and sending means for connecting the player input terminal to the processor; (5) a video monitor at the player input terminal; (B) the processor configured to execute software in program-containing memory to perform a process comprising: i) providing an image of a virtual playing card having m columns and n rows and diagonals of open frames at a monitor at player terminal, wherein each of m and n are at least 3; ii) providing a random distribution of individual numbers within the frames, the individual numbers selected from within a complete defined set of numbers, the complete defined set of numbers having predefined subsets of numbers that appear only in particular game card sections selected from the group consisting of rows or columns; iii) recognizing at least one wager at a player input terminal; iv) the player input terminal identifying to the processor a selected second set of play numbers from within the complete defined set of numbers, wherein the second set of play numbers is smaller than the complete defined set, v) the processor randomly selecting a predetermined number of numbers from each subset; vi) identifying on the monitor selected numbers from v) matching individual random numbers within the frames from iv); vii) identifying when consecutive frames have at least p matched individual random numbers within frames in a column, row or diagonal on a monitor at a player input terminal, wherein p is greater than 1 and up to m and n; viii) resolving the at least wager such that a) when matched individual random numbers do not form at least p adjacent frames, collecting the wager, and b) when matched individual random numbers do form at least p adjacent frames, resolving the at least one wager by providing credit at the player input terminal where the at least one wager was recognized.

2. The system of claim 1 wherein the image of a virtual playing card wherein m is between 3 and 10 and n is between 3 and 8 and p is at least two and vii) b) includes resolving the at least one wager by providing credit at the player input terminal where the at least one wager was recognized and providing a payout for filling frames in specifically identified positions on multiple frames, including corners of a virtual playing card.

3. The system of claim 2 wherein m is between 4 and 10 and n is between 4 and 8 and p is at least 3 and vii) b) includes resolving the at least one wager by providing credit at the player input terminal where the at least one wager was recognized.

4. The system of claim 1 wherein the processor is configured to randomly assign the random distribution of individual numbers within the frames, and the random distribution within the defined subsets being delivered only to their designated sections.

5. The system of claim 1 wherein the processor is configured to assign numbers selected at the player input terminal as the random distribution of individual numbers within the frames.

6. The system of claim 1 wherein the processor is configured to distribute the complete defined set of numbers as individual subsets of numbers comprising q numbers for each column as 1 . . . m subsets or for each row as 1 . . . n subsets, with each individual subset of numbers to be distributed only within a single row or a single column and the second set of numbers from within the complete defined set of numbers selected consists of second subsets of numbers wherein each second subset of numbers is less than q.

7. The system of claim 2 wherein the processor is configured to distribute the complete defined set of numbers as individual subsets of numbers comprising q numbers for each column as 1 . . . m subsets or for each row as 1 . . . n subsets, with each individual subset of numbers to be distributed only within a single row or a single column and the second set of numbers from within the complete defined set of numbers selected consists of second subsets of numbers wherein each second subset of numbers is less than q.

8. The system of claim 3 wherein the processor is configured to distribute the complete defined set of numbers as individual subsets of numbers comprising q numbers for each column as 1 . . . m subsets or for each row as 1 . . . n subsets, with each individual subset of numbers to be distributed only within a single row or a single column and the second set of numbers from within the complete defined set of numbers selected consists of second subsets of numbers wherein each second subset of numbers is less than q.

9. The system of claim 4 wherein the processor is configured to distribute the complete defined set of numbers as individual subsets of numbers comprising q numbers for each column as 1 . . . m subsets or for each row as 1 . . . n subsets, with each individual subset of numbers to be distributed only within a single row or a single column and the second set of numbers from within the complete defined set of numbers selected consists of second subsets of numbers wherein each second subset of numbers is less than q.

10. The system of claim 5 wherein the processor is configured to distribute the complete defined set of numbers as individual subsets of numbers comprising q numbers for each column as 1 . . . m subsets or for each row as 1 . . . n subsets, with each individual subset of numbers to be distributed only within a single row or a single column and the second set of numbers from within the complete defined set of numbers selected consists of second subsets of numbers wherein each second subset of numbers is less than q.

11. The system of claim 1 wherein multiple virtual playing cards are used at a player input terminal during a single game, and the processor executes code to determine adjacent numbers in columns, rows and diagonals in three dimensions among the multiple play cards.

12. The system of claim 11 wherein the multiple play cards comprise at least three adjacent play cards.

13. The system of claim 1 wherein the processor accepts separate wagers at the player input terminal on paylines within columns, rows and diagonals having fewer available numbers than an entire set of numbers in the column, row or diagonal.

14. The system of claim 1 wherein the processor executes code to provide random secondary features to individual numbers, and where the processor executes code to increase payouts on winning adjacent number winning events when predetermined combinations of the secondary features are present with winning adjacent number events.

15. The system of claim 1 wherein the processor executes code to provide random secondary features to individual numbers, and where the processor executes code to increase payouts on winning adjacent number winning events when predetermined combinations of the secondary features are present with winning number events.

* * * * *